US012286858B1

(12) United States Patent
Rogers et al.

(10) Patent No.: US 12,286,858 B1
(45) Date of Patent: Apr. 29, 2025

(54) PLUG CONTAINER, METHOD AND APPARATUS

(71) Applicant: Citadel Casing Solutions, LLC, Houston, TX (US)

(72) Inventors: Henry E. Rogers, Owasso, OK (US); Nicolas Rogozinski, Evergreen, CO (US)

( * ) Notice: Subject to any disclaimer, the term of this patent is extended or adjusted under 35 U.S.C. 154(b) by 0 days.

(21) Appl. No.: 18/517,134

(22) Filed: Nov. 22, 2023

Related U.S. Application Data

(63) Continuation of application No. 17/166,269, filed on Feb. 3, 2021, now Pat. No. 11,828,129.

(51) Int. Cl.
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 33/068; E21B 34/02
See application file for complete search history.

(56) References Cited

U.S. PATENT DOCUMENTS

| | | | | |
|---|---|---|---|---|
| 3,777,819 | A | 12/1973 | Delano | |
| 4,574,882 | A | 3/1986 | Szarka | |
| 4,995,457 | A | 2/1991 | Baldridge | |
| 5,095,988 | A | 3/1992 | Bode | |
| 5,443,122 | A | 8/1995 | Brisco | |
| 8,651,174 | B2 * | 2/2014 | Barbee | E21B 33/14 166/70 |
| 8,997,850 | B2 | 4/2015 | Barbee et al. | |
| 9,109,415 | B2 * | 8/2015 | Coles | E21B 43/116 |
| 9,341,040 | B2 | 5/2016 | Barbee et al. | |
| 10,539,007 | B2 * | 1/2020 | Dirksen | E21B 17/003 |
| 2003/0024701 | A1 * | 2/2003 | Simson | E21B 33/165 166/291 |
| 2020/0157909 | A1 | 5/2020 | Fernandes et al. | |

* cited by examiner

*Primary Examiner* — Aaron L Lembo

(74) *Attorney, Agent, or Firm* — Avek IP, LLC

(57) ABSTRACT

A wellbore plug container includes a body with an interior to house a lower plug and an upper plug, the body having an upper plunger assembly and a lower plunger assembly extending from the side of the body; a manifold system having a manifold body forming a first flow path into the interior of the body at a position below the lower plunger assembly, a second flow path into the interior of the body at a position below the upper plunger assembly, and third flow path into the interior of the body at a position above the upper plug; valves housed within the manifold system to open and close the flow paths; a connection extending from the manifold body and to attach to a piece of pumping equipment; and a tubular connection to connect the body and manifold system to a casing for use with a wellbore.

16 Claims, 9 Drawing Sheets

PLUG CONTAINER, METHOD AND APPARATUS

RELATED APPLICATION

This application claims priority to U.S. application Ser. No. 17/166,269 filed Feb. 3, 2021, which is incorporated in its entirety herein.

FIELD OF THE DISCLOSURE

The present invention relates generally to well drilling operations, and more specifically to an apparatus and method of use for surface cementing operations where conventional surface launch cementing plugs are used.

DESCRIPTION OF RELATED ART

Wellbore systems are well known in the art and are effective means to collect resources for energy use.

BRIEF DESCRIPTION OF THE SEVERAL VIEWS OF THE DRAWINGS

Illustrative embodiments of the present disclosure are described in detail below with reference to the attached drawing figures.

Figure 1:
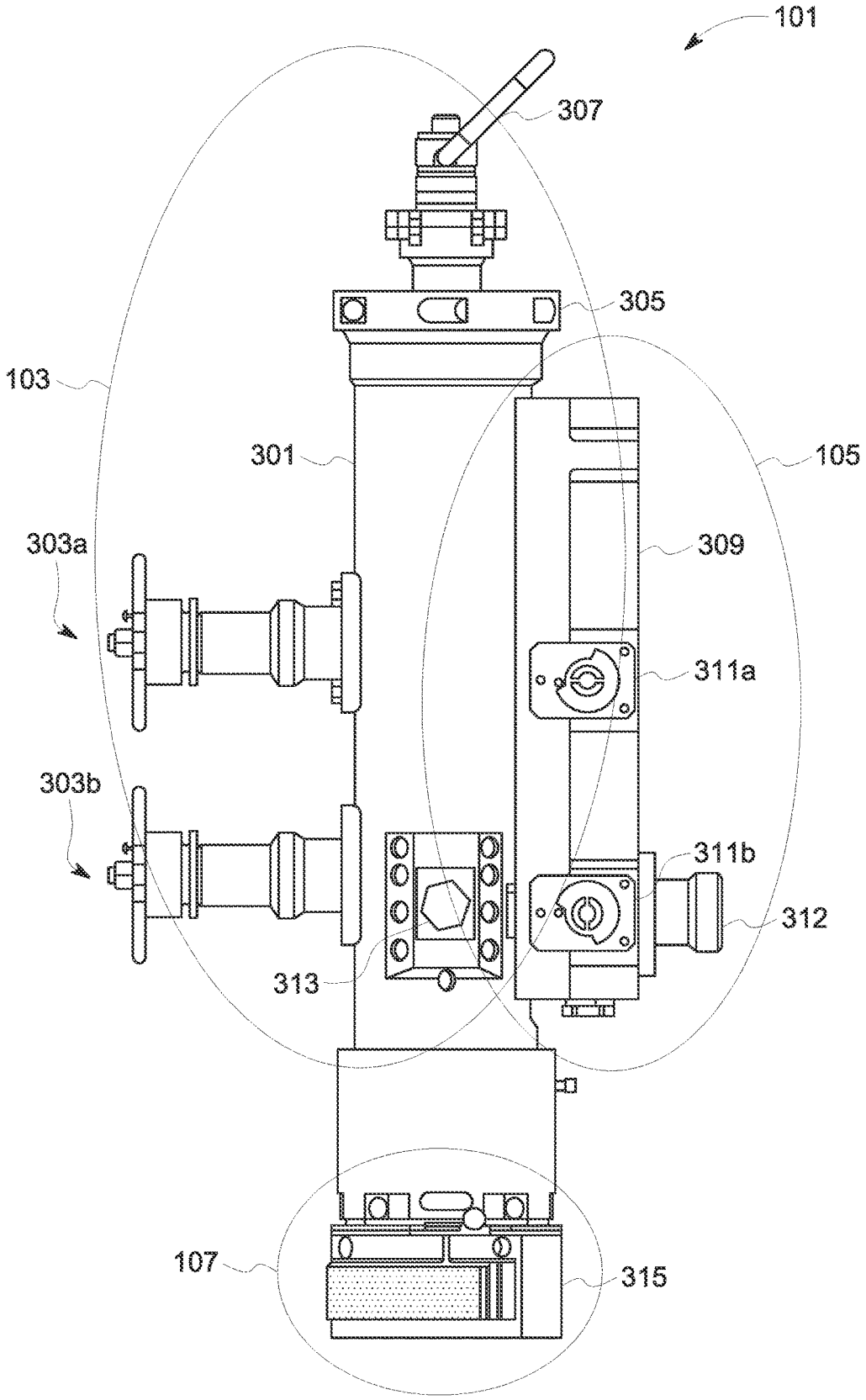
FIG. 1 is a front view of a preferred embodiment of the apparatus of the present invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Referring now to the drawings wherein like reference characters identify corresponding or similar elements throughout the several views, FIGS. 1-10 depict various views of an apparatus 101 in accordance with a preferred embodiment of the present application.

In the contemplated embodiment, apparatus 101 includes three primary components, namely a body and plungers 103, a manifold system 105, and a tubular connection 107. It should be appreciated that the three primary components are broken up and explained herein, however, these components provide for novelty and improvement over the prior art.

Specifically, the body and plunger portion are where cementing plugs are installed and located during the circulation operations of a well drilling operation. The cementing plugs remain in this portion of the head until the plungers are retracted, and the fluid is diverted into the manifold to launch the plug into the casing.

The manifold is a system is in fluid communication with the interior of the body and is a configuration of flow paths that can be manipulated to direct fluid flow to a location on the body that is desired by the operator. Specifically, the fluid flow is initially directed below the lower plunger assembly. Wherein a second step involves retracting the lower plunger assembly, and the flow is directed to below the upper plunger assembly and above the lower cementing plug. It should be understood that the change in fluid flow serves to launch the lower cementing plug from the cement head. In a third step, this process is repeated to divert the flow to below the cap and above the upper cementing plug after retracting the upper plunger assembly. This serves to launch the upper cementing plug into the casing of the wellbore operation. It should be appreciated that the steps above are completed with the manifold system, wherein the manifold system opens and closes valves as commanded to create the needed fluid flow.

The tubular connection is used to adjoin the plug container body to the casing mechanically with a hydraulic seal with said casing to enable pressure pumping operations to be performed.

It should be appreciated that one of the unique features believed characteristic of the present application is the combination of the above three primary features.

Figure 2A:
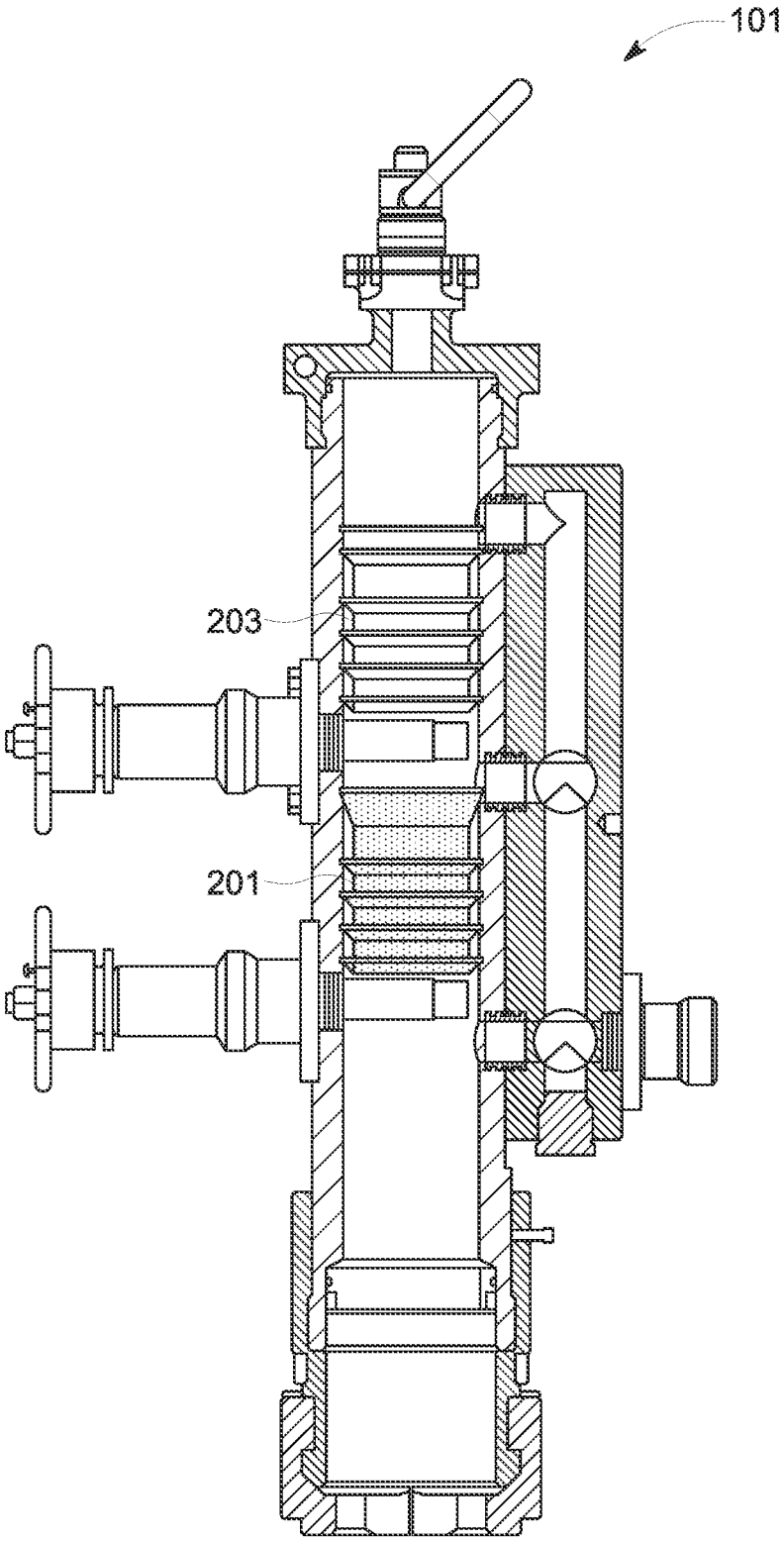
FIGS. 2A, 2B, and 2C are front views depicting use of the apparatus of FIG. 1 for launching plugs.
Figure 2B:
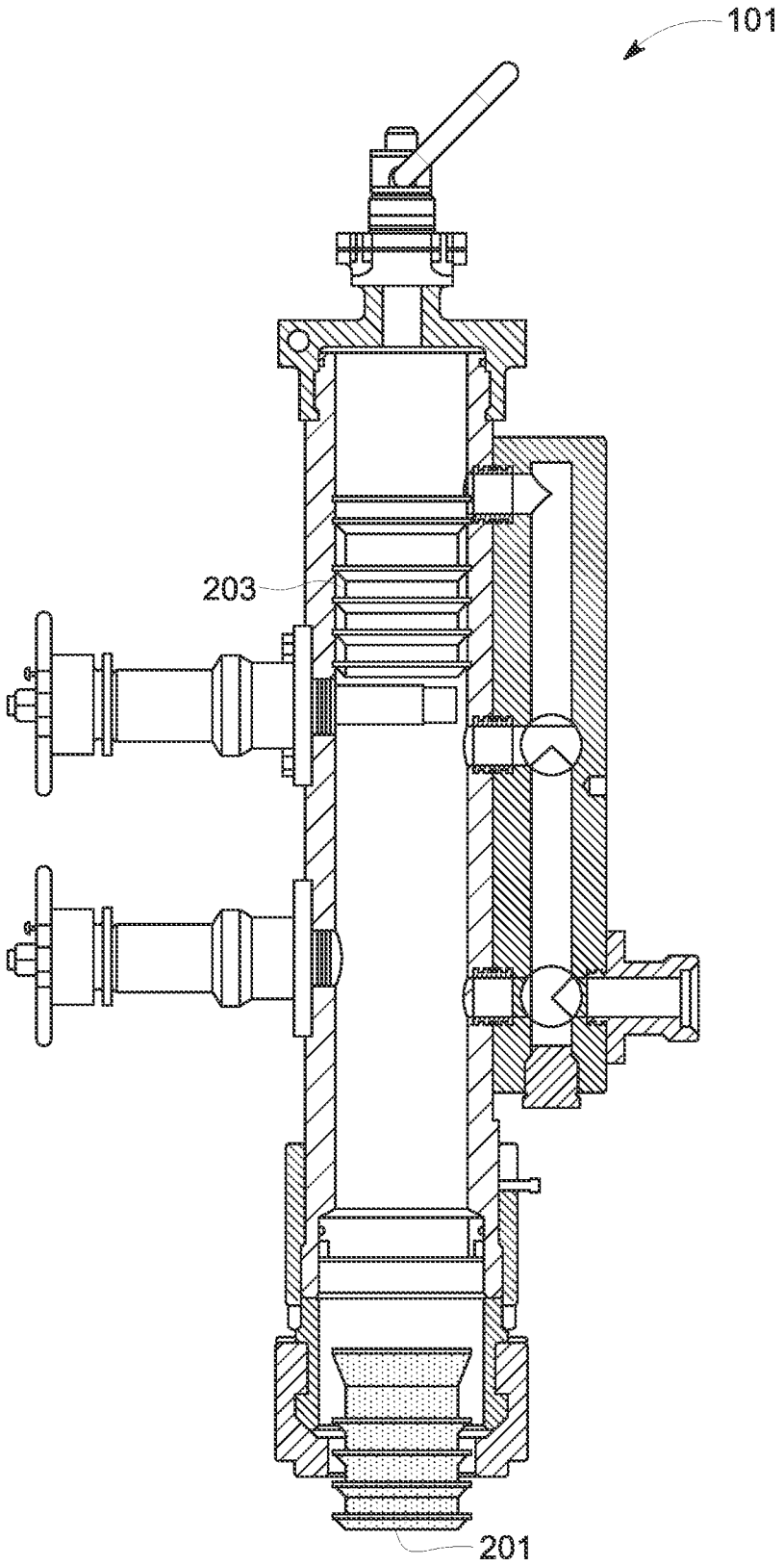
Figure 2C:
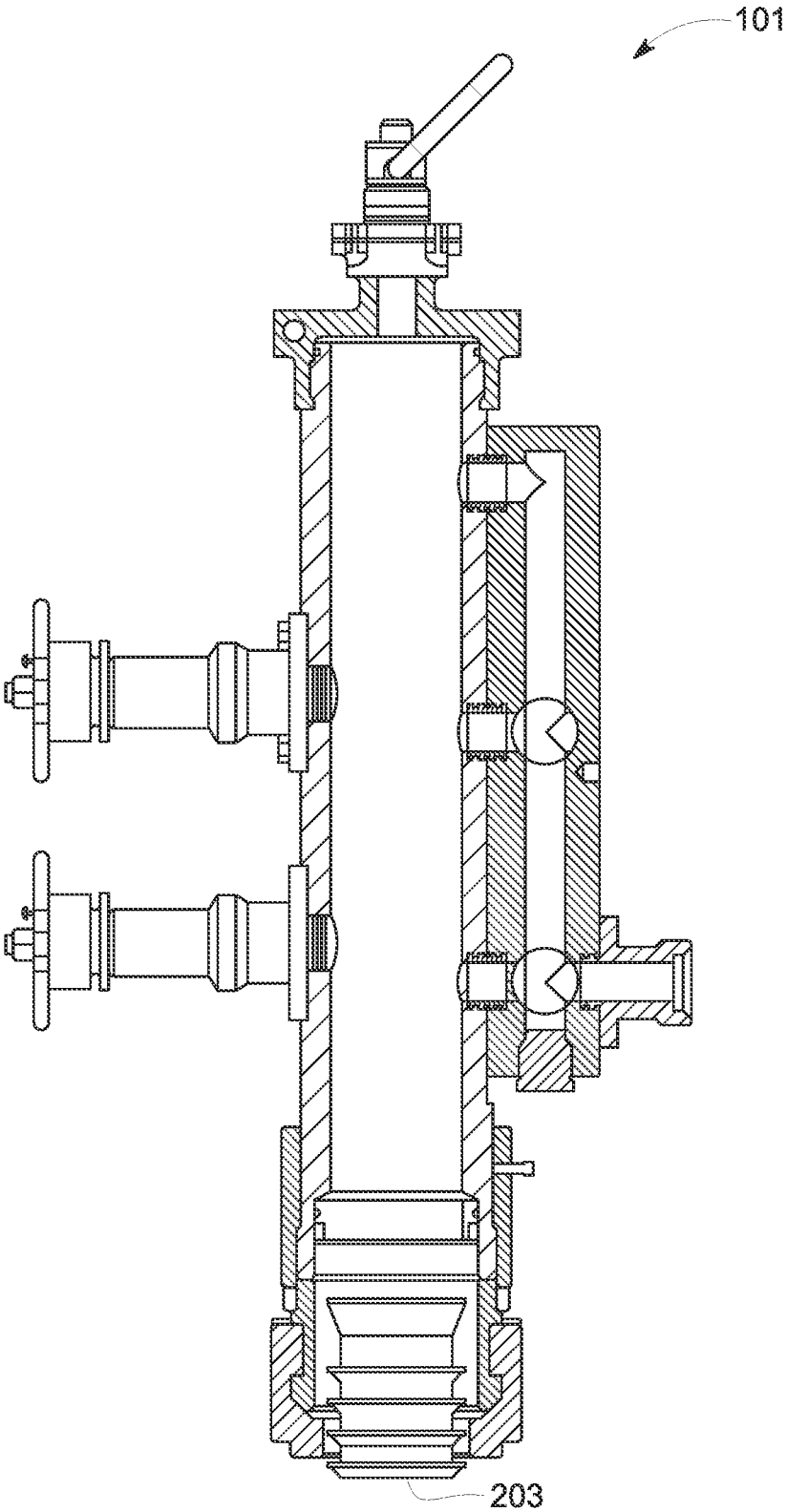

In FIGS. 2A, 2B, and 2C, a series of three front views depicts the process of launching cement plugs through apparatus 101. As shown in the first image, fluid is diverted to circulation. As shown in the second image, fluid is then diverted to release the bottom plug 201 by being diverted to above the bottom plug 201 and below the upper plug 203. As shown in the third image, the fluid flow is then diverted to below the cap and above the upper plug 203 to release the upper plug.

Referring back to FIG. 1, a front view of apparatus 101 is shown with details. Apparatus 101 including a main body 301 with upper and lower plunger assemblies 303*a*-*b* attached thereto. The upper plunger assembly 303*a* extends from the side of the body at a position higher than the lower plunger assembly 303*b* as shown. As shown, and should be appreciated, the plunger assemblies extend into the interior of the body, wherein the plugs 201, 203 are housed.

The body 301 further includes a plug container cap 305 positioned at the top end of the body and a hoist ring 307 positioned above the container cap. The manifold includes a manifold body 309 bolted onto the main body 301 with upper and lower manifold valve assemblies 311 *a-b* with a handle for actuating the valve assemblies. As shown, the valves are configured to direct fluid flow into the interior of the body at two different positions. The manifold further including a 2-inch 1502 thread 312 for flow iron bolted onto the body. Further included is a cementing plug launch indicator 313 bolted onto the main body and a coupler clamp assembly 315 threaded onto the main body.

Another unique feature believed characteristic of the present invention is the manifold assembly 105. The manifold assembly is fabricated from steel that is machined to create flow paths that are managed with valves that divert the fluid flow to a desired path. This manifold assembly provides for a simple and efficient operation when compared to the prior art. Further, using a monoblock assembly reduces the number of leak paths common to manifolds that are assembled from numerous individual pieces assembled together to make a manifold assembly.

Figure 3:
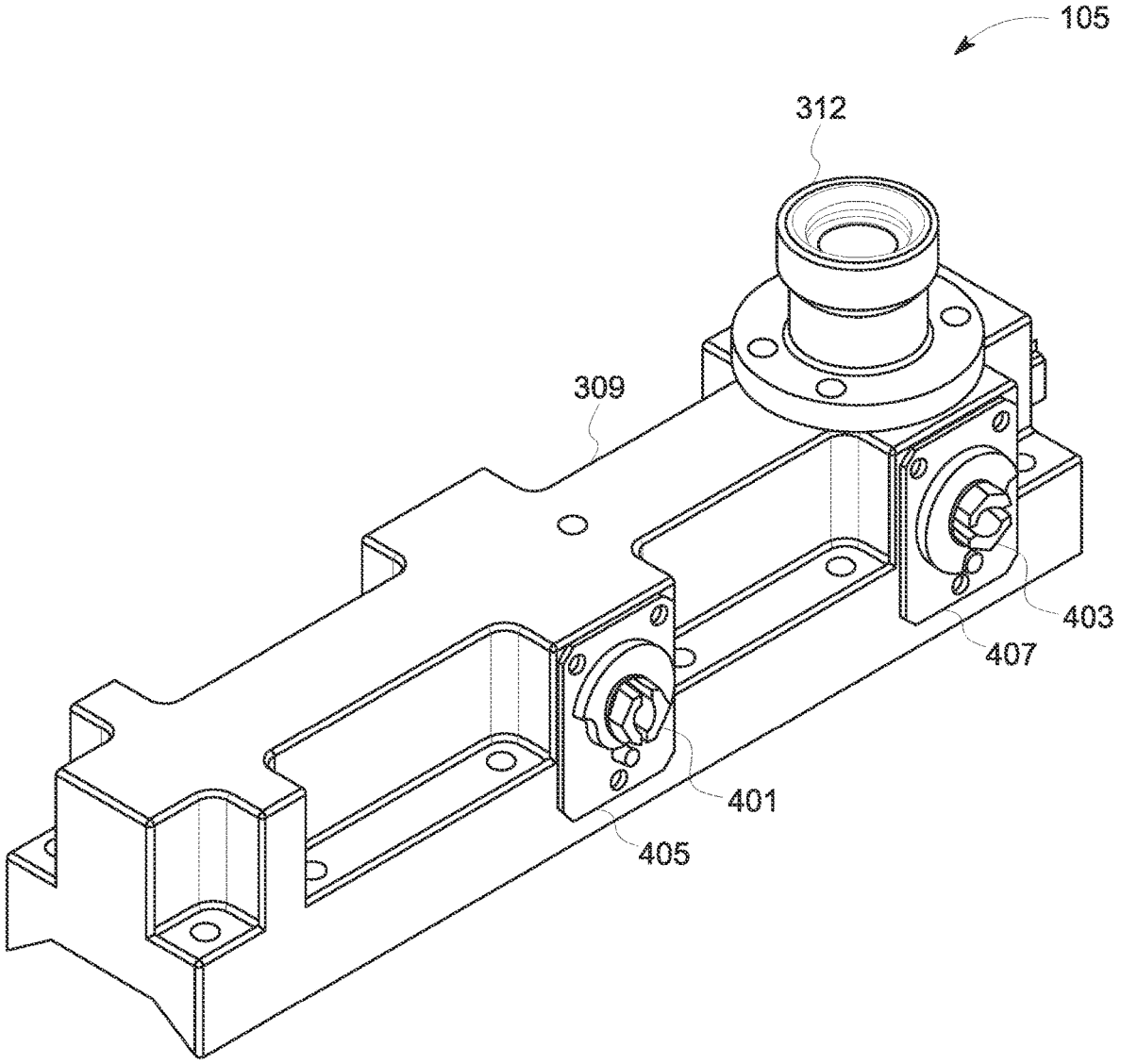
FIG. 3 is an isometric view of a manifold of the apparatus of FIG. 1.
Figure 4:
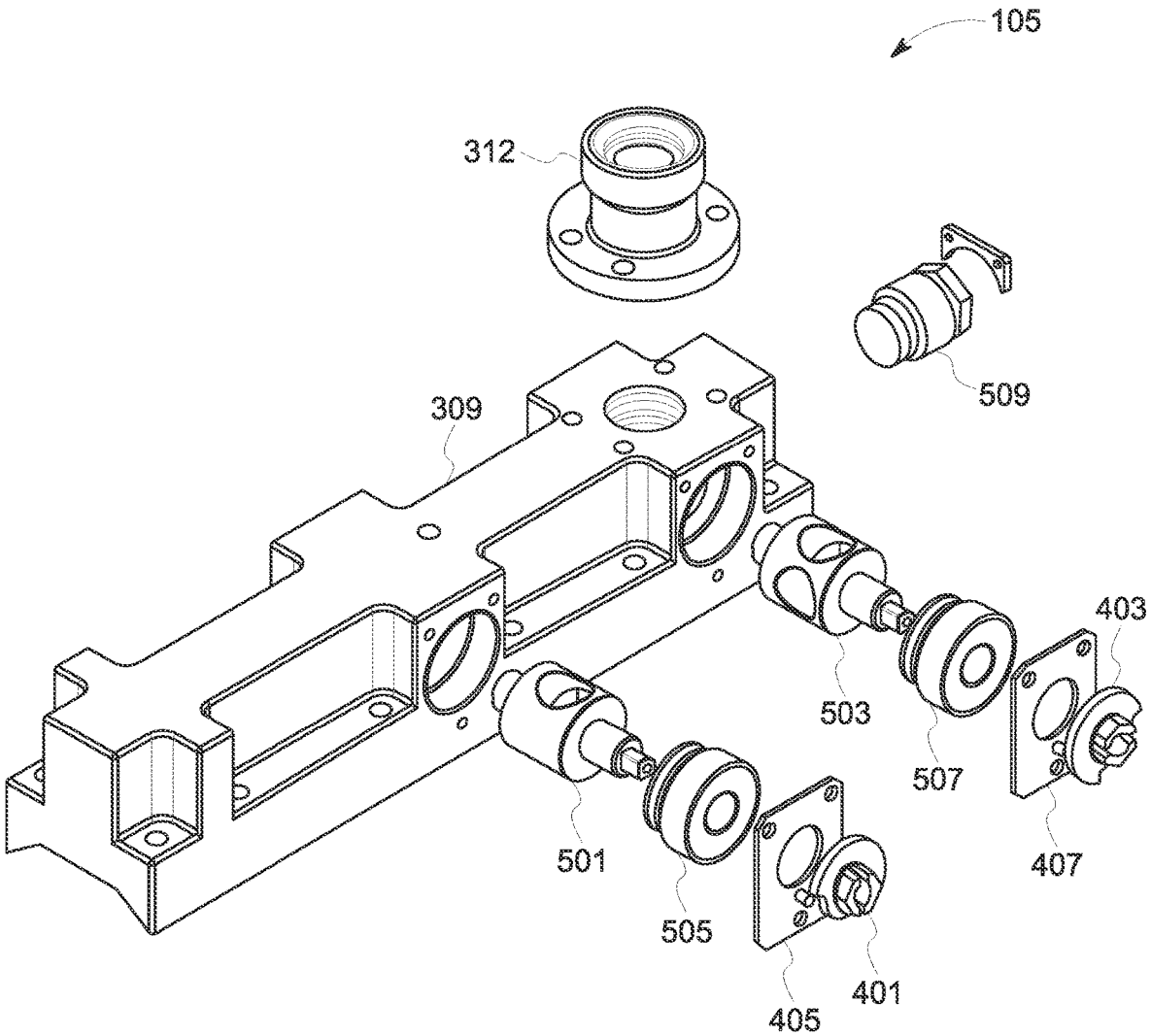
FIG. 4 is an isometric exploded view of the manifold of FIG. 3.

The manifold assembly and components therefore are shown and described in FIGS. 3-4. As shown in FIGS. 3 and 4, the manifold assembly includes the manifold body 309 with the 2-inch 1502 thread connection 312 wherein pumping equipment would can connect to the manifold. Valve assemblies include handles 401, 403 configured to engage with valves 501, 503 through cover plates 405, 407 and valve nuts 505, 507. Additionally, there is a manifold bore plug 509. It should be appreciated that the manifold could be configured with additional valves. The valves aid in directing and diverting flow within the manifold body.

Figure 5:
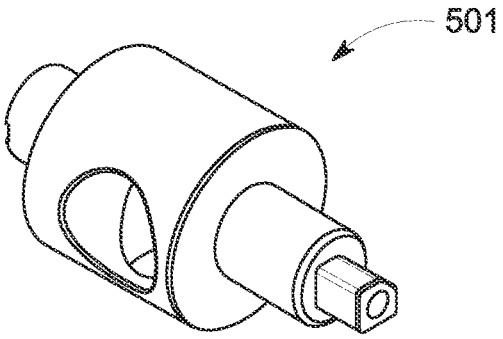
FIG. 5 is an isometric view of a manifold valve used in the manifold of FIG. 3.
Figure 6:
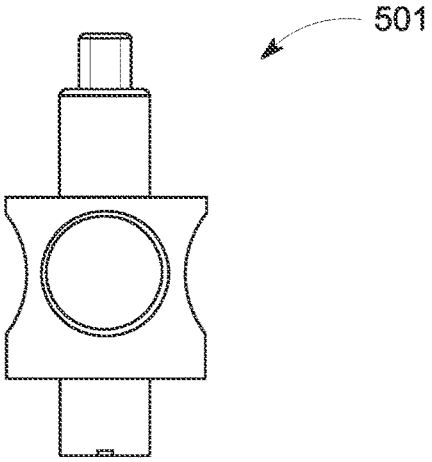
FIG. 6 is a side view of the manifold valve of FIG. 5.
Figure 7:
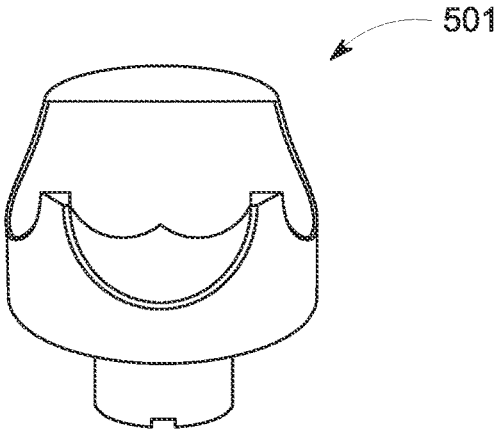
FIG. 7 is a cut away view of the manifold valve of FIG. 5.

In FIGS. 5-7, various views of a valve 501 are shown in accordance with the present invention. In the preferred embodiment, the valve is a hydraulically balanced valve with identical shaft diameters on both ends.

Figure 8:
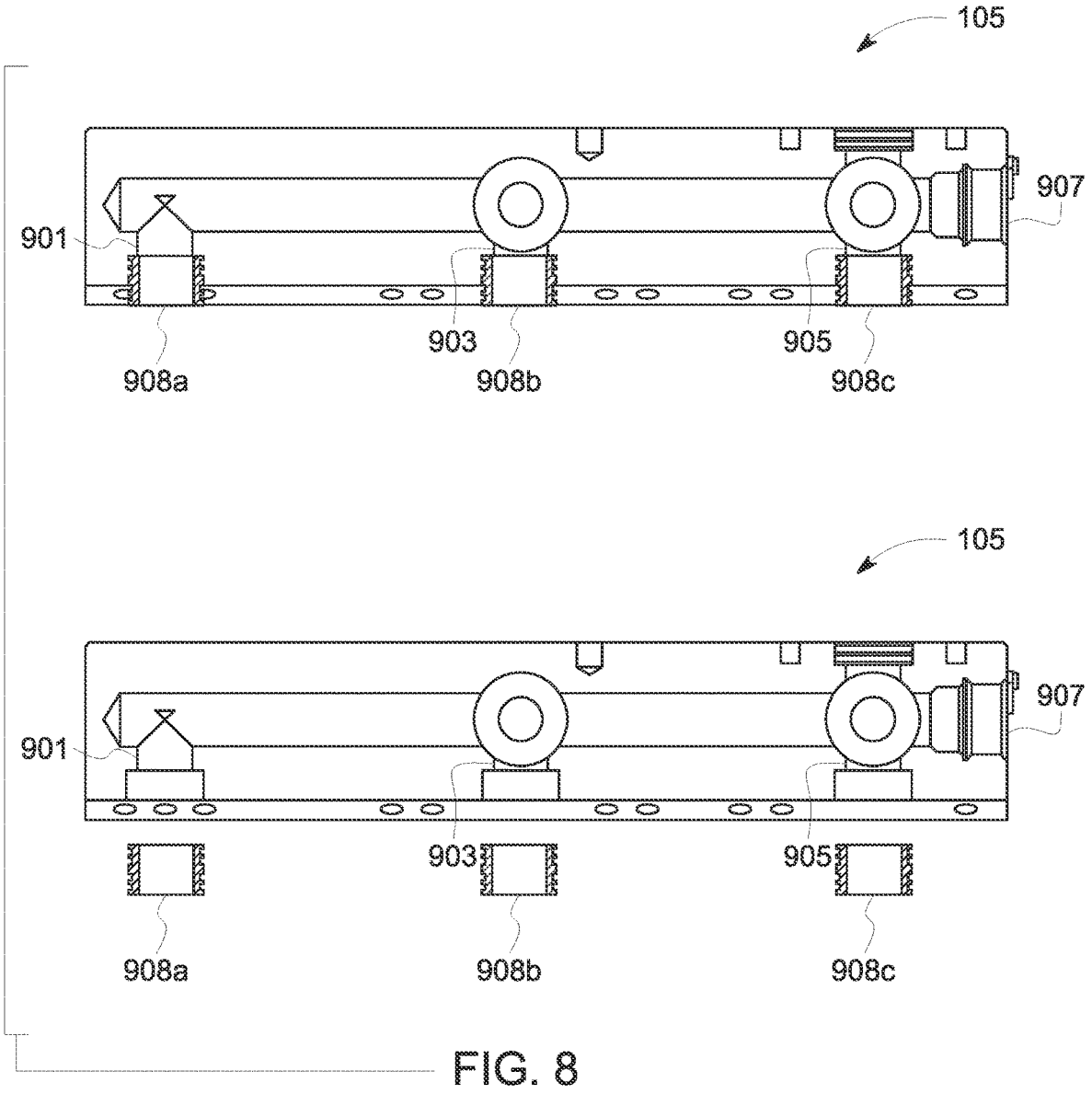
FIG. 8 is a side view of the manifold of FIG. 3.

In FIG. 8, a simplified side view depicts the manifold assembly 105 flow paths, namely an upper manifold flow path 901, an upper valve and middle flow path 903, a lower valve and lower flow path 905, and a thread for manifold bore plug 907. Further included is a plurality of spacer tubes 908*a-c* that provide for connection between manifold 105 and body 301.

Figure 9:
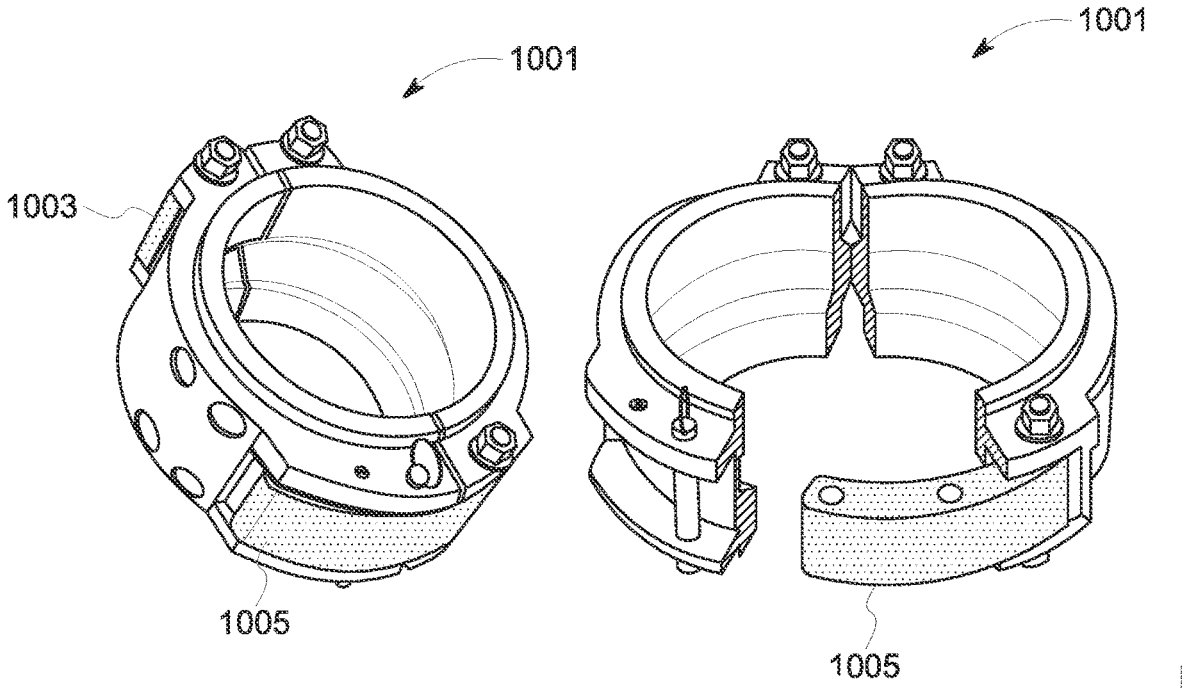
FIG. 9 shows an isometric closed and open view of a coupling clamp of the apparatus of FIG. 1.

In FIG. 9, a coupling clamp 1001 in accordance with the present invention is shown. The coupling clamp 1001 is configured to adjoin to a casing during wellbore operations. The coupling clamp 1001 includes a hinge 1003 and a latch 1005 to allow for opening and closing.

Figure 10:
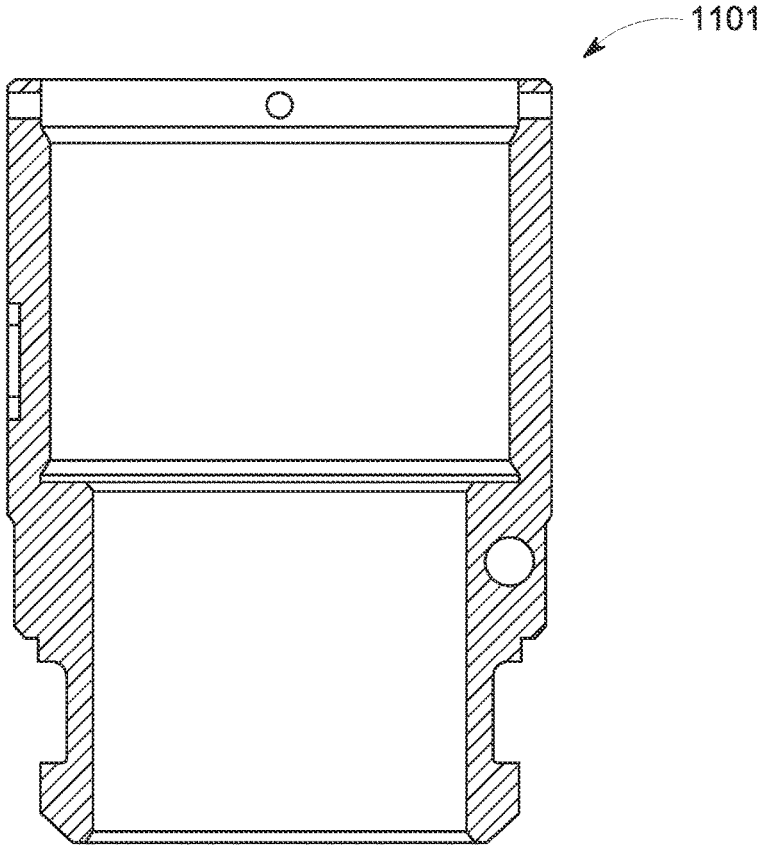
FIG. 10 is a side view of an adjustable nut used with the coupling clamp of FIG. 9.

In FIG. 10, an adjustable nut 1101 is shown, the adjustable nut being configured to adjust the coupling clamp latch length to allow for the coupling clamp latch to mate with various casing coupling lengths.

The apparatus of the present invention provides for benefits over the prior art, namely, the manifold block enables the use of fewer connections, thus reduces the number of leak paths common to a conventional manifold system; the manifold block allows 90° rotation of a single valve to divert fluid flow from one path to a second path; the manifold block allows the center of gravity to me moved closer to the plug container body, thus eliminate the need for lift chains or a leveling bar; the manifold block creates a less costly and more easily maintainable manifold system compared to a conventional valve manifold system; the non-welded coupling clamps improve the fabrication of and the long-term maintenance of the clamps by using the dual pin hinge to eliminate welds.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A wellbore plug container, comprising:

a body with an interior to house a lower plug and an upper plug, the body having:

an upper plunger assembly extending from a side of the body and blocking the upper plug; and a lower plunger assembly extending from the side of the body at a position lower than the upper plunger assembly, the lower plunger assembly blocking the lower plug;

a manifold system having:

a manifold body having a central channel extending from a top end to a bottom end and a plurality of secondary channels extending perpendicular to the central channel and fluidly connecting the central channel to the interior of the body, wherein the central channel and the plurality of secondary channels form a first flow path into the interior of the body at a position below the lower plunger assembly, a second flow path into the interior of the body at a position below the upper plunger assembly, and third flow path into the interior of the body at a position above the upper plug, the third flow path created by an uppermost channel of the plurality of secondary channels;

a plurality of valves housed within the manifold system and configured to operate to open and close the first, second, and third flow paths;

a connection extending from the manifold body and configured to attach to a piece of pumping equipment for receiving fluid therefrom and directing the fluid therefrom to the first, second, and third flow paths; and a tubular connection configured to connect the body and manifold system to a casing for use with a wellbore;

wherein fluid flow is first directed below the lower plunger via the first flow path;

wherein the lower plunger assembly is retraced in a second step and fluid flow is directed to below the upper plunger assembly and above the lower plug via the second flow path, thereby causing the lower plug to launch; and wherein fluid flow is diverted to above the upper plug via the third flow path after retraction of the upper plunger assembly in a third step, such that the fluid flow acts directly upon the upper plug to launch the upper plug.

2. The plug container of claim 1, wherein the body further comprises:

a container cap positioned at a top end of the body; and a hoist ring positioned above the container cap.

3. The plug container of claim 1, wherein the plurality of valves further comprises:

a first valve configured to open and close the first flow path; and a second valve configured to open and close the second flow path; and wherein the third flow path is only open when both the first valve and the second valve are in open positions.

4. The plug container of claim 3, wherein the plurality of secondary channels further comprises a bottom secondary channel configured to be open and closed via the first valve and a middle secondary channel configured to be open and closed via the second valve.

5. The plug container of claim 3, further comprising a first handle configured to operate the first valve and a second handle configured to operate the second valve.

6. The plug container of claim 1, further comprising a coupler clamp assembly threaded onto the body at a bottom end.

7. The plug container of claim 1, further comprising a plug launch indicator attached to the body.

8. The plug container of claim 1, wherein the connection of the manifold assembly is at a position below the lower plunger assembly.

9. The plug container of claim 1, wherein the manifold body is monolithic, the central channel and the plurality of secondary channels being formed as a single unit and wherein the manifold body directly provides for fluid flow into the body without additional connecting components.

10. A manifold system as part of a wellbore plug container, the manifold system comprising:

a manifold body extending from a top end to a bottom end;

a central channel extending from near the top end of the manifold body to near the bottom end of the manifold body;

a plurality of secondary channels in fluid communication with the central channel and extending away from the central channel at substantially right angles;

a plurality of valves positioned within the central channel, each of the plurality of valves configured to open and close one or more of the plurality of secondary channels to allow fluid flow through the one or more secondary channels, wherein all of the plurality of valves must be in an open position for an uppermost channel of the plurality of secondary channels to be fluidly connected to a connection; and the connection extending from the manifold body and configured to attach to a piece of pumping equipment for receiving fluid therefrom, the connection extending from the manifold body at a position equal to or below a lowermost channel of the plurality of secondary channels.

11. The manifold system of claim 10, wherein the plurality of valves further comprises:

a first valve configured to open and close a first of the plurality of secondary channels; and a second valve configured to open and close a second of the plurality of secondary channels.

12. The manifold system of claim 11, wherein the first valve and the second valve are positioned within the central channel.

13. The manifold system of claim 12, wherein the first valve is a lowermost valve of the manifold system and the connection extends away from the manifold body at a position substantially even with the first valve.

14. The manifold system of claim 10, further comprising one or more handles configured to operate the one or more valves.

15. The manifold system of claim 10, wherein the manifold body is monolithic, the central channel and plurality of secondary channels being formed from a single unit.

16. The manifold system of claim 10, wherein the central channel and plurality of secondary channels are configured to selectively provide a first flow path, a second flow path, and a third flow path, wherein:

the first flow path extends from the connection, then into the central channel, and then into a lowermost channel;

the second flow path extends from the connection, then into the central channel, past the lowermost channel, and then into a middle channel; and the third flow path extends from the connection, then into the central channel, past the lowermost channel, past the middle channel, and then into the uppermost channel.

* * * * *